US005885147A

United States Patent [19]

Kreager et al.

[11] Patent Number: 5,885,147

[45] Date of Patent: Mar. 23, 1999

[54] APPARATUS FOR CONDITIONING POLISHING PADS

[75] Inventors: Douglas P. Kreager, Lake Oswego, Oreg.; Junedong Lee, Gilbert, Ariz.

[73] Assignee: Integrated Process Equipment Corp., Phoenix, Ariz.

[21] Appl. No.: 854,862

[22] Filed: May 12, 1997

[51] Int. Cl.[6] ..... B24B 29/00

[52] U.S. Cl. ..... 451/443; 451/56; 451/444; 451/324

[58] Field of Search ..... 451/56, 443, 444, 451/41, 285, 287, 312, 313, 319, 324

[56] References Cited

U.S. PATENT DOCUMENTS

| | | | |
|---|---|---|---|
| 159,216 | 1/1875 | Randall . | |
| 4,084,356 | 4/1978 | Brears . | |
| 4,621,465 | 11/1986 | Pangburn . | |
| 5,109,637 | 5/1992 | Calafut . | |
| 5,154,021 | 10/1992 | Bombardier et al. . | |
| 5,216,843 | 6/1993 | Breivogel et al. . | |
| 5,230,184 | 7/1993 | Bukham | 451/41 |
| 5,351,447 | 10/1994 | Grauert . | |
| 5,384,986 | 1/1995 | Hirose et al. | 451/444 |
| 5,426,814 | 6/1995 | Minnick . | |
| 5,456,627 | 10/1995 | Jackson et al. . | |
| 5,486,131 | 1/1996 | Cesna et al. . | |
| 5,547,417 | 8/1996 | Breivogel et al. . | |
| 5,593,342 | 1/1997 | Thibaut . | |
| 5,611,943 | 3/1997 | Cadien et al. . | |
| 5,626,509 | 5/1997 | Hayashi | 451/285 |

*Primary Examiner*—Eileen P. Morgan
*Attorney, Agent, or Firm*—Quarles & Brady

[57] ABSTRACT

A flexible conditioning apparatus and method for uniformly conditioning a polishing surface of a pad used to remove undesirable irregularities from a silicon wafer and to achieve a planar condition of the polishing pad. In a preferred embodiment of the present invention, a roughening member comprising a plurality of point contacts, such as diamond particles, is adapted for movement into and out of engagement with the surface of the pad. A flexible member supporting the roughening member allows the roughening member to conform to the surface of the pad to achieve uniform polishing of the pad.

23 Claims, 4 Drawing Sheets

APPARATUS FOR CONDITIONING POLISHING PADS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to the field of semiconductor manufacturing and more specifically to the field of chemical-mechanical polishing (CMP) and to an apparatus for conditioning a polishing pad used in semiconductor manufacturing to polish or planarize a silicon wafer or similar work piece.

2. Description of Prior Art

CMP is used primarily for polishing or "planarizing" the front face of a semiconductor wafer. A silicon wafer typically is fabricated as a disk, and the wafer thereafter is subjected to a masking process in preparation for using it, for example, in a production of integrated circuits.

The masking process causes numerous undesired irregularities on a device surface of the wafer. To remove rough spots and irregularities from the wafer and to produce a planar surface of substantially uniform thickness on the wafer, a CMP process may be used.

FIG. 1 illustrates a cross-sectional view of a typical orbital CMP polisher. During CMP with an orbital polisher 1, a semiconductor wafer ("wafer") 10 is placed onto a polishing pad 12 that has been coated with an abrasive and chemically reactive solution, slurry, which typically is comprised of a colloidal silica. Wafer 10 is held in place and made to bear against a polishing pad surface by a carrier 14. Carrier 14 may be a rigid table or a flexible table comprised of a pliable material. Polishing pad is attached to the top of a flexible or rigid table or platen 16.

Polishing pad 12 typically is constructed in two layers overlying a platen with the less resilient layer on the outer layer of the polishing pad. The hardness and density of the polishing pad 12 depends on the type of material that is to be polished. The parameters of polishing, such as the pressure on the wafer, the rotational speed of the carrier, the speed of the polishing pad, the flow rate of the slurry, and the pH of the slurry are carefully controlled to provide a uniform removal rate, a uniform polish across the surface of the wafer, and consistency from wafer to wafer.

Polishing pad 12 typically is larger than the diameter of the wafer 10 being polished, and wafer 10 generally is kept off-center of the polishing pad to prevent grinding of a non-planar surface into the wafer. Wafer 10 and polishing pad 12 may both axially rotate, or polishing pad 12 may be rotated about a vertical axis while wafer 10 is placed in a confined position. Under either system, slurry may be distributed to the wafer/polishing pad interface through a plurality of holes 18 formed throughout the polishing pad 12. The rotation of polishing pad 12 about the surface of wafer 10 causes the polishing pad to rub against the device surface thereby bringing about abrasive wear of the surface in engagement with the polishing surface.

As a wafer is polished, the slurry and abraded materials tend to glaze the surface of the polishing pad, making the polishing pad slick and reducing the polishing rate and efficiency. Polishing can produce stray particles from the polishing pad material, the wafer itself, or elsewhere. It is important that the polishing pad surface be maintained in planar condition and substantially free of surface irregularities.

One method of countering the glazing or smoothing of the polishing pad surface and achieving and maintaining high and stable polishing rates is to "condition" the polishing pad by removing old slurry particles and abraded particles which develops on the surface. Scraping the polishing pad with a sharp object or roughening the polishing pad with an abrasive material restores the polishing pad's surface, thus increasing the ability of the polishing pad to absorb slurry and increasing the polishing rate and efficiency of the polishing system. During or after conditioning, the polishing pad may be rinsed with water to remove the particles and irregularities loosened during the conditioning process.

Most known polishing pad conditioning systems use an abrasive disk to increase the roughness of the polishing pad and counter the glazing process. In one known conditioning method, as described in U.S. Pat. No. 5,216,843 (Breivogel et al.) and as shown in FIG. 2, a multitude of fine micro-grooves 20 are formed in the surface of a polishing pad 12 by pivoting a diamond pointed conditioning block 22 back and forth across an annular area 26 of the polishing pad 12 which contacts the wafer 10. This technique tends to produce nonuniform conditioning, and the effectiveness of the conditioning is limited.

Moreover, because the conditioning block 22 is rigidly connected to conditioning arm 24, operating efficiency is dependant upon the relative motion of the polishing pad 12 and the conditioning block 22, and effective conditioning cannot be achieved without decreasing the polishing rate, and thereby decreasing wafer throughput and increasing fabrication costs. The rigid conditioning assembly cannot achieve maximum uniform conditioning because the conditioning assembly is unable to fully conform to irregularities and unevenness generally present on the surface of the polishing pad at the time of conditioning.

U.S. Pat. No. 5,547,417 (Breivogel et al.) describes a "ball and socket" joint to attempt to achieve uniform contact with polishing pad 18 when irregularities are present on the polishing pad 18. However, this "ball and socket" joint device still provides for a rigid conditioning block with mobility only in the vertical plane. It does not allow for a compliancy in the conditioning block 22 to achieve maximum uniform conformity and contact between the conditioning block 22 and the polishing pad 18 and does not allow the conditioning assembly to conform to minor irregularities in the polishing pad.

Another known method for conditioning a polishing pad uses a large diameter diamond particle covered disk, as described in U.S. Pat. No. 5,456,627 (Jackson et al.). In this method, the large disk is pressed against the polishing pad and axially rotated while the polishing pad rotates. This conditioning technique requires a large diameter disk and has been found less than optimal due to a combination of insufficient surface flatness and inability to track surface variations across the polishing track left in the polishing pad. Moreover, this conditioning device tends to gouge portions of the polishing pad while insufficiently conditioning other portions. The rigidity of the structure of this conditioning device does not allow for uniform conditioning because the disk does not have the flexibility to remain in uniform contact with the polishing pad when irregularities and unevenness are present in the polishing pad.

BRIEF SUMMARY OF THE INVENTION

In view of the foregoing, it is therefore an object of the invention to provide an improved device for efficient, uniform conditioning of a polishing pad that has been used to remove undesirable surface irregularities from a silicon wafer and achieve a planar polishing pad condition.

The further object of the invention is to provide a method for conditioning of polishing pads after use to remove surface irregularities and achieve a planar polishing pad condition.

Other objects, features and advantages of the present invention will be apparent from the following description of the preferred embodiment of the invention as illustrated in the accompanying drawings.

The foregoing objects are achieved in the present invention which provides an improved apparatus for uniformly conditioning a polishing surface of a polishing pad used to remove undesirable irregularities from a silicon wafer and to achieve a planar condition of the polishing pad. In a preferred embodiment of the present invention, a flexible roughening member comprising a plurality of point contacts, such as diamond particles, is swept across the entire polishing surface of the polishing pad. A flexible member is situated between the roughening member and a backer bar, which is affixed to a conditioner arm. The flexible member provides flexibility and allows the roughening member to conform to the surface of the polishing pad.

BRIEF DESCRIPTION OF THE DRAWINGS

A more complete understanding of the invention is obtained by considering the following detailed description in conjunction with the accompanying drawings, in which.

DETAILED DESCRIPTION OF THE INVENTION

A method and apparatus for conditioning of chemical-mechanical polishing pads is disclosed. In the following description, numerous specific details are set forth, such as specific equipment, materials, processes, dimensions, etc. in order to provide a thorough understanding of the present invention. It will be obvious, however, to one skilled in the art that these specific details need not be employed to practice the present invention. In other instances, well known materials or methods have not been described in detail in order to avoid unnecessarily obscuring the present invention.

Figure 1:
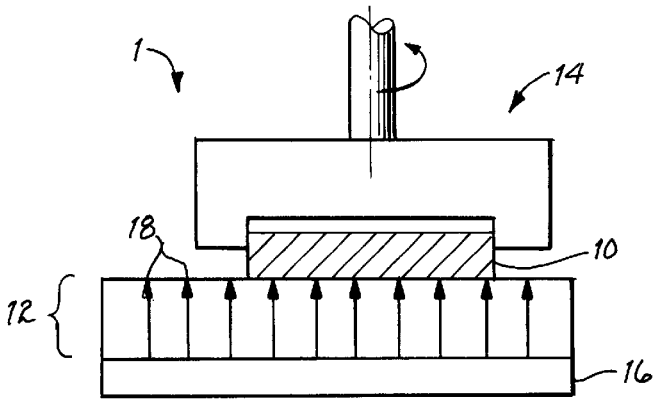
FIG. 1 (PRIOR ART)
FIG. 1 illustrates a cross section of one prior embodiment of a chemical-mechanical polisher.
Figure 2:
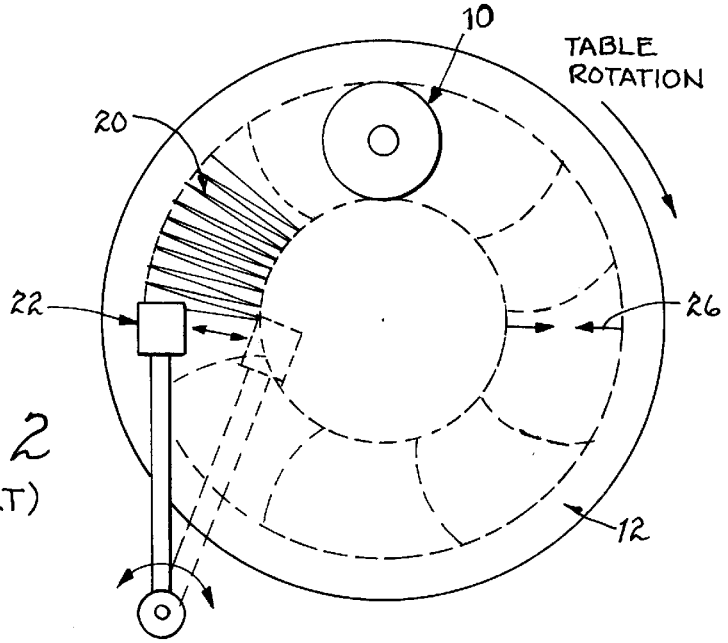
FIG. 2 (PRIOR ART)
FIG. 2 illustrates a polishing pad conditioning device constructed in accordance with the prior art.

Polishing pad 12 of the chemical-mechanical polisher illustrated in FIG. 1, can be made of a variety of materials. For instance, the polishing pad may comprise a relatively hard polyurethane or similar material when used in planarization of an oxide based inter-layered dielectric. For polishing metals, such as tungsten, the polishing pad can be a urethane impregnated felt polishing pad. In one currently preferred embodiment, a hard polyurethane polishing pad is used in the orbital polisher illustrated in FIG. 1.

The type of polishing pad generally determines what roughening member should be used for conditioning. For example, the surface of the polishing pad may be scored with diamond particles, discrete diamond points, brushes with stiff bristles, brushes with soft bristles. When hard polishing pads are used, such as polishing pads having polyurethane surfaces, diamond particles or points, or cutting teeth frequently are used for conditioning the polishing pad. Intermediate polishing pad surfaces may be conditioned using a brush with stiff bristles, and soft polishing pad surfaces, such as urethane impregnated felt polishing pads, may be conditioned using either soft bristle brushes or high pressure spray.

Where a hard polyurethane polishing pad is used in the orbital polisher 1, illustrated in FIG. 1, a preferred method of conditioning is to place diamond particles or points in uniform contact with the surface of the polishing pad. It should be noted that although the present invention is described below with reference to roughening the polishing pad surface with diamond particles, it will be obvious to one with ordinary skill in the art that other methods of conditioning may also be used, for example, the brushes, cutting teeth, discussed above or similar roughening devices. Additionally, it should be noted that although the present invention is described with reference to an orbital polisher, it will be obvious to one with ordinary skill in the art that it may be used in conjunction with other chemical-mechanical polishers to achieve similar results.

Figure 3:
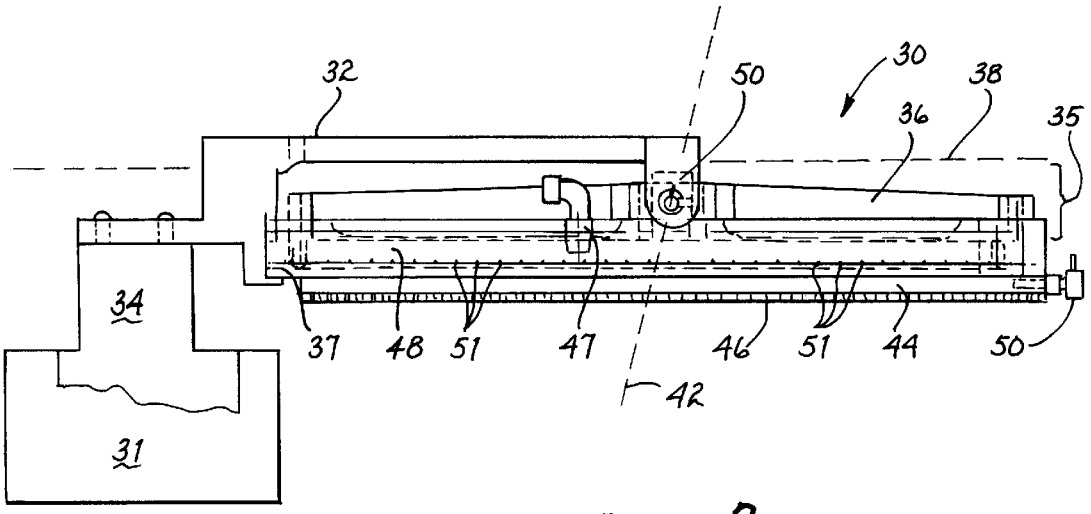
FIG. 3 illustrates a side view of one preferred embodiment of the polishing pad conditioning device of the present invention.
Figure 4:
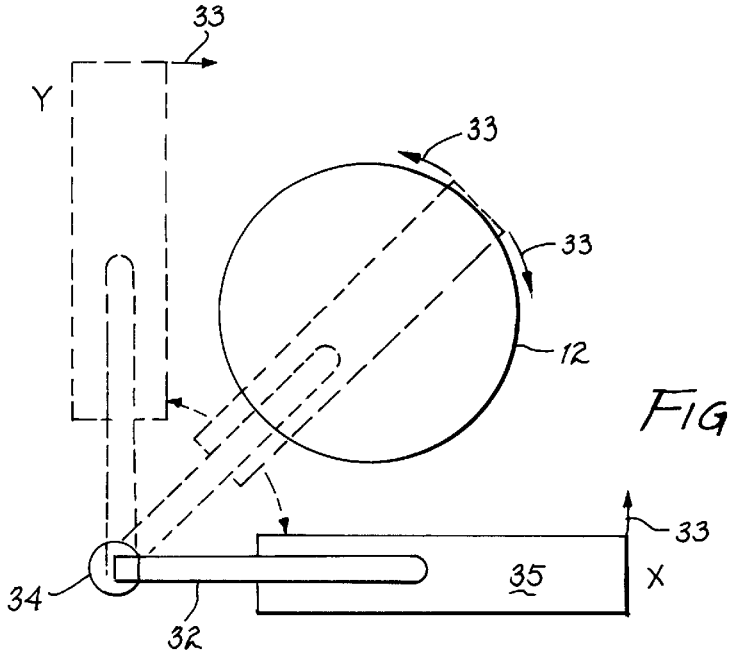
FIG. 4 illustrates an overhead view of one preferred embodiment of the present invention.
Figure 5:
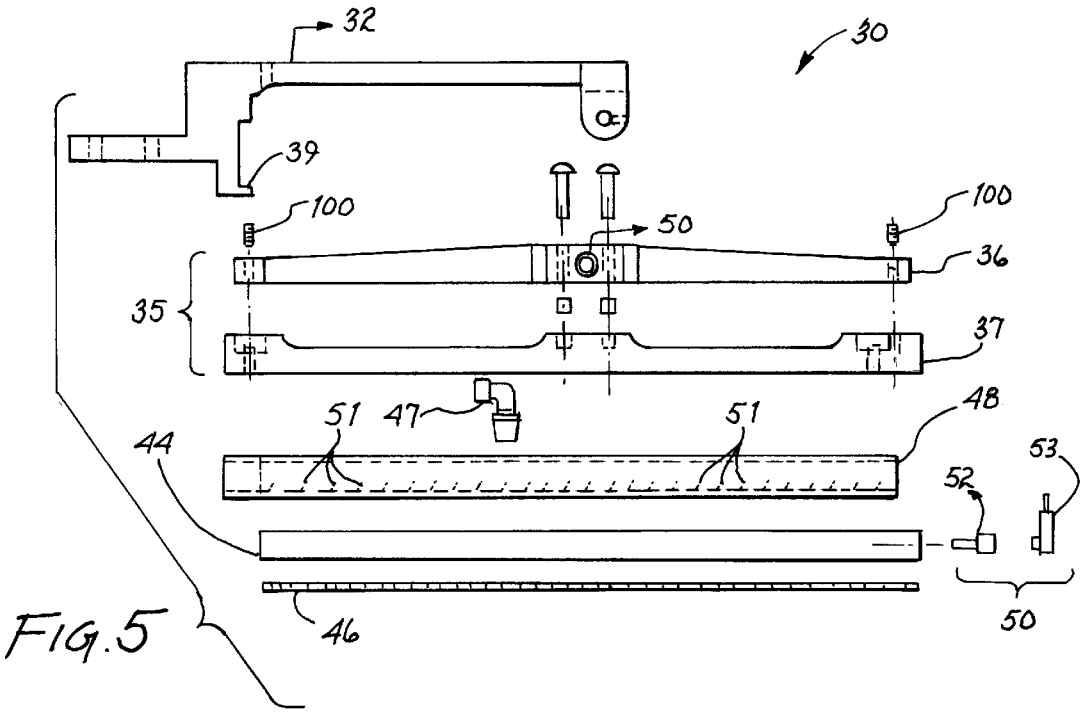
FIG. 5 is an exploded side view of the conditioning device of the present invention.
Figure 6:
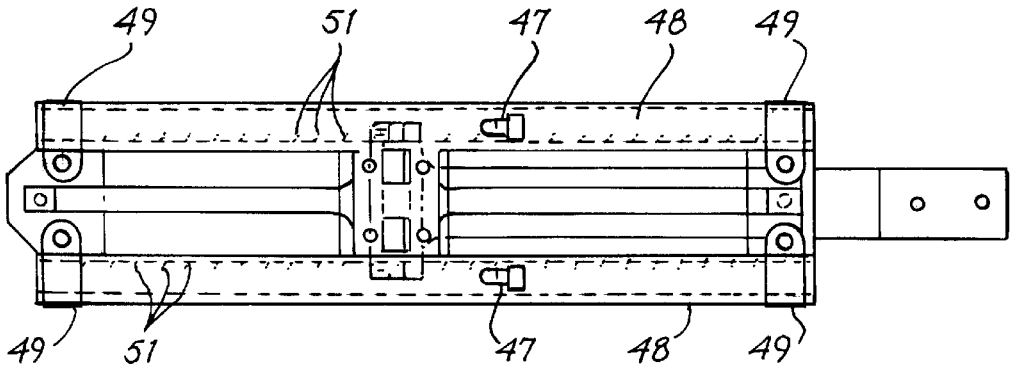
FIG. 6 is a detailed top view of the polishing pad conditioning device of the present invention.
Figure 7:
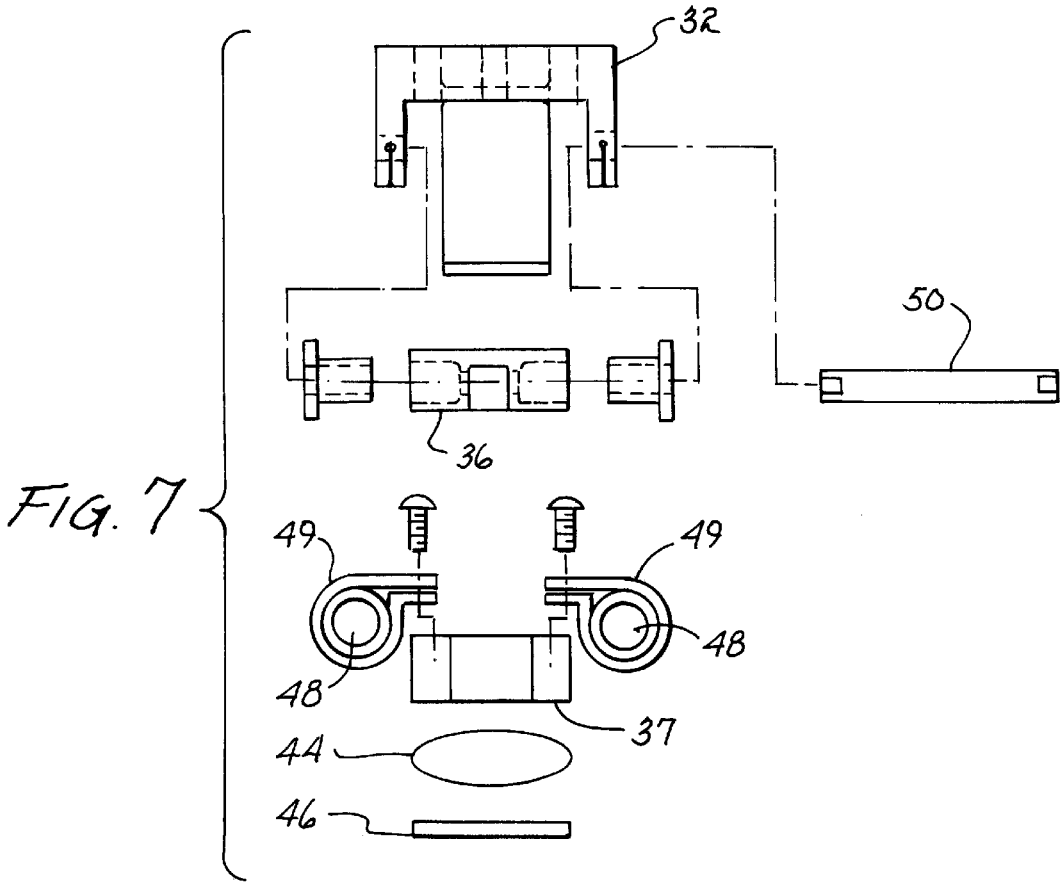
FIG. 7 is an exploded end view of the conditioning device of the present invention.

FIGS. 3 and 4 illustrate a side view and an overhead view of one preferred embodiment of the conditioning apparatus 30 of the present invention. FIGS. 5, 6, and 7 illustrate, respectively, an exploded side view, a detailed top view, and an exploded end view of the conditioning apparatus 30. Conditioning apparatus 30 may be used in conjunction with the chemical-mechanical polisher illustrated in FIG. 1, to roughen and/or rinse the polishing pad 12, such that polishing pad 12 is uniformly conditioned.

Conditioner arm 32 is mounted at a first point (preferably, but not necessarily a first end of conditioner arm) onto a shaft 34. Rotation of the shaft 34 may be selected by programming a computer (not shown) coupled to a bidirectional drive motor 31. The drive motor 31 causes the conditioner arm 32 and components attached thereto to pivot through a programmable arc of up to 90° over the polishing pad 12 as seen in FIG. 4. As shown in detail in FIGS. 5 and 7, an elongated carrier 35 is pivotally coupled at a horizontal axis 42 by a pin hinge 50 to the conditioner arm 32. The coupling is at a remote point from the first point preferably, but not necessarily at a second end of conditioner arm). The carrier 35 is in substantial alignment with the longitudinal axis 38 of conditioner arm 32 and is not rotatable in the horizontal plane.

In one preferred embodiment, elongated carrier 35 comprises a backer bar 36 and a backer plate 37 fixedly attached to the backer bar and substantially aligned with longitudinal axis 38 of conditioner arm 32. Carrier is pivotally connected to the end of conditioner arm 32 such that carrier 35 is capable of a defined range of pivotal movement. As shown in FIG. 5, Conditioner arm 32 has a retainer 39 comprised of a notch which engages carrier 35 to limit upward and downward rotational tilt of carrier 35 about the horizontal axis 42 as is apparent in FIG. 3. Backer bar preferably is a stainless steel support member which provides a stable connection between the conditioner arm 32 and the backer bar 36 and flexible member 44. Additionally, a curvature control system, comprising two set screws 100, is incorporated into the backing bar. The curvature control system allows the curvature of the backer bar 36 and corresponding backer plate 37, which is a compliant polymer material in the preferred embodiment of the present invention, to be adjusted to correspond with the inherent shape present in some pad/platen systems.

Figure 8:
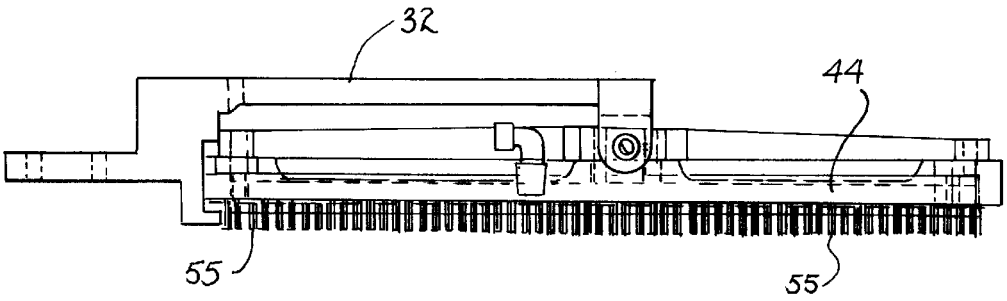
FIG. 8 illustrates a side view of one preferred embodiment of the present invention.
Figure 9:
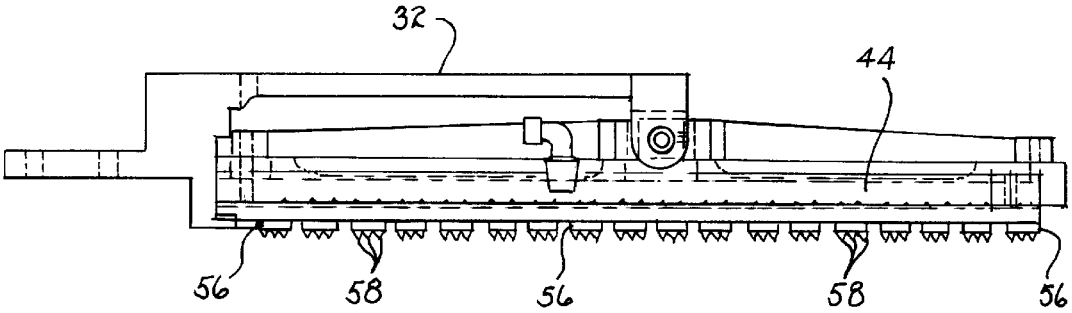
FIG. 9 illustrates a side view of another preferred embodiment of the present invention.

In a currently preferred embodiment of the present invention, as illustrated in FIGS. 5 and 7, a flexible member 44 is affixed to backer plate 37, and an abrasive diamond strip 46 is affixed to the flexible member 44, thereby providing a compliant roughening member which is capable of achieving uniform contact with the surface of the polishing pad 12. It will be obvious to one with skill in the art that different roughening devices may be used depending on the hardness of the polishing pad surface, including, for example, a brush or brushes 55, as illustrated in FIG. 8, or one more abrasive tiles 56 having a plurality of cutting points 58 arising therefrom affixed to the flexible member, as illustrated in FIG. 9. In a preferred embodiment, the aforementioned abrasive tiles are ceramic tiles ranging in thickness from 0.100 to 0.250 inches, and having machined-in cutting points ranging in height from 0.002 to 0.010 inches.

Flexible member 44 is made of an elastomeric material, such as EPDM rubber, and is present in tubular form, in the preferred embodiment of the present invention. Flexible member 44 can be inflated by passing fluid, such as air or water, through inlet 50, which is inserted near an end of flexible member 44 and which is comprised, in the preferred embodiment, of a flexible member fitting 53, coupled to a flexible member fitting adapter 52.

With reference to FIGS. 5–7, at least one fluid delivery member, preferably in the form of a spray tube 48 is affixed by clamps 49 to the backer plate 37 in close proximity with a flexible roughening member 46. Preferably, a spray tube 48 having holes 51 would be located on each side of the carrier 35 so that fluid precedes the roughening member 46 as it moves across the polishing pad surface in each direction, as shown by arrows 33 in FIG. 4. Water or other liquid flows into the spray tube/s 48 through rigid elbow member 47 and is distributed through holes 51 along the length of the spray tube/s 48 to facilitate the polishing process by rinsing excess slurry and contaminants loosened by the roughening member 46. Distributing water from the spray tube 48 is one preferred embodiment of the present invention, and it will be obvious to one skilled in the art that solutions other than water may be delivered through the tubular spraying member 48.

When the polishing pad 12 is moving, and a wafer is being polished, conditioner apparatus 30 remains in the inactive position X situated adjacent to the polishing pad 12. After a predetermined number of wafers have been polished by polishing pad 12, or when the polishing rate has been decreased to an undesired level due to build up of slurry and other debris, polishing pad 12 should be conditioned. Preferably, polishing pad conditioning is employed after each polish cycle. The wafer should be removed from the polishing pad before the polishing pad is conditioned.

After removing the wafer 10 from the polishing pad 12, the polishing pad may be conditioned. Conditioner arm 32 of conditioning apparatus 30 is pivoted at one end by shaft 34 and swept along an arc indicated by arrows 33 from an inactive, or resting position X adjacent to a perimeter of polishing pad 12 across a major surface of polishing pad (as shown by phantom lines) used for polishing the wafer, to a second position Y adjacent polishing pad 12 (also shown by phantom lines). Flexible member 44 allows roughening member 46 to conform uniformly to the polishing surface of the polishing pad 4. It will be obvious to one with ordinary skill in the art that although a diametric arm is portrayed in FIGS. 3 and 4, a radial arm also may be used.

It should be noted, that the conditioning apparatus of the present invention could be employed in a conditioning system or apparatus other than the conditioner described herein, including, for example, a concentric conditioning system as described in U.S. Pat. No. 5,611,943 (Cadien et al.), a radial-type conditioning system as described in U.S. Pat. No. 5,456,627, and others. In such alternative embodiment, the flexible member would be located between the conditioner arm 32 and the roughening member 46, thus providing a means to conform to the surface variations of the pad. The flexible member also could be employed in conjunction with a ring-shaped, or other non-elongated conditioning member, such as a standard disk conditioner, wherein the roughening member faces the pad to be conditioned, and the flexible member would be situated between the top of the roughening member 46 and the conditioner arm 32. The roughening member could comprise a plurality of diamond particles affixed to the non-elongated flexible member, a plurality of brushes affixed to the flexible member, or a ceramic disk having a plurality of cutting points extending therefrom, or other similar abrasive configurations.

The flexible member conditioning apparatus 30 described herein achieves uniform conditioning of an entire polishing pad surface because the roughening member is free to move vertically and horizontally during conditioning thereby allowing the planar bottom surface of the roughening member to remain in uniform contact with the polishing pad, even where irregularities and unevenness are present in the polishing pad.

We claim:

1. An apparatus for conditioning a polishing surface of a polishing pad having a perimeter, said apparatus comprising:

a conditioner arm having a longitudinal axis with a first and a second point therealong, and being situated to pivot about the first point adjacent the perimeter of said polishing pad;

an elongated carrier extending along a carrier axis and pivotally coupled to pivot about a horizontal axis at the second point along said conditioner arm and the carrier axis substantially parallel with said longitudinal axis the carrier having a length along the carrier axis not less than the diameter of the polishing pad such that the carrier axis remains substantially coplanar with the longitudinal axis when the elongated carrier pivots about the horizontal axis; and a roughening member affixed to said carrier for conditioning the polishing surface of the polishing pad, wherein pivoting of said conditioner arm about the first point sweeps said roughening member across the entire polishing surface to condition the polishing pad.

2. The apparatus of claim 1, wherein said carrier comprises a backer bar pivotally coupled at the second point of said conditioner arm; and a backer plate fixedly attached to said backer bar wherein said roughening member is affixed to said backer plate.

3. The apparatus of claim 1, wherein said conditioner arm has a retainer which engages the carrier to limit pivotal movement of the carrier about the horizontal axis.

4. The apparatus of claim 1, further comprising a fluid delivery member coupled to said carrier for delivering fluid to facilitate conditioning by rinsing away particles and debris loosened from the polishing pad by the roughening member.

5. The apparatus of claim 1, further comprising a mechanism coupled to said conditioner arm at the first point for rotating said conditioner arm from a resting position at which said roughening member is situated outside the perimeter of said polishing pad, across the polishing surface of said polishing pad to a second position situated outside the perimeter of said polishing pad.

6. The apparatus of claim 5, further comprising a mechanism coupled to said conditioner arm at the first point for reciprocally moving said conditioner arm from said second position, across the polishing surface of said polishing pad to said resting position.

7. The apparatus of claim 1, wherein said roughening member comprises a plurality of diamond particles affixed along the length of said carrier.

8. The apparatus of claim 1, wherein said roughening member comprises a brush affixed along the length of said carrier.

9. The apparatus of claim 1, wherein said roughening member comprises a plurality of cutting points affixed along the length of said carrier.

10. An apparatus for conditioning a polishing surface of a polishing pad having a perimeter, said apparatus comprising:

a conditioner arm having a longitudinal axis with a first and a second end, said first end of said conditioner arm being situated adjacent the perimeter of said polishing pad;

an elongated carrier extending along a carrier axis to present a substantially rigid lower surface of predefined curvature and pivotally coupled to pivot about a horizontal axis at the second end, the carrier axis being substantially coplanar with said longitudinal axis; and elastic member supported along said lower surface of the carrier; and a roughening member affixed to said elastic member;

wherein pivoting of said conditioner arm brings said roughening member into and out of engagement with the surface of said polishing pad and wherein said elastic member flexes to allow said roughening member to conform to the polishing surface of said polishing pad to achieve uniform conditioning of said polishing surface.

11. The apparatus of claim 10, further comprising a carrier pivotally connected to said conditioner arm wherein said elastic member is coupled to said carrier.

12. The apparatus of claim 11, wherein said carrier comprises a backer bar fixedly coupled to said conditioner arm in substantial alignment with said longitudinal axis of said conditioner arm for sweeping said backer bar across the diameter of the entire polishing surface of the polishing pad.

13. The apparatus of claim 11, wherein said carrier comprises a backer bar pivotally coupled at a horizontal axis to the second end of said conditioner arm; and a backer plate fixedly attached to said backer bar wherein said roughening member is affixed to said backer plate.

14. The apparatus of claim 11, further comprising a fluid delivery member coupled to said carrier for delivering fluid to the surface of the polishing pad to facilitate conditioning by rinsing away particles and debris loosened by contact with the roughening member.

15. The apparatus of claim 14, wherein said fluid delivery member is a tube having a plurality of spray holes through which fluid may be distributed to the surface of the polishing pad.

16. The apparatus of claim 10, wherein said elastic member is a tube composed of an elastomeric material containing a fluid.

17. The apparatus of claim 16, wherein said fluid is water.

18. The apparatus of claim 16, wherein said fluid is air.

19. The apparatus of claim 10, wherein said roughening member comprises a plurality of diamond particles.

20. The apparatus of claim 10, wherein said roughening member comprises a brush.

21. The apparatus of claim 10, wherein said roughening member comprises a plurality of cutting points.

22. The apparatus of claim 21, wherein said cutting points arise from one or more ceramic tiles affixed to said flexible member.

23. The apparatus of claim 10 wherein said carrier is adapted for vertical movement into and out of substantially perpendicular engagement with the surface of the polishing pad and for oscillating radial movement over the surface of the polishing pad.

* * * * *